United States Patent [19]

Weibel, Jr. et al.

[11] 4,041,723

[45] Aug. 16, 1977

[54] ROOM AIR CONDITIONER WITH TIMER

[75] Inventors: John Weibel, Jr.; Donald C. Ferdelman, both of Dayton, Ohio

[73] Assignee: General Motors Corporation, Detroit, Mich.

[21] Appl. No.: 738,612

[22] Filed: Nov. 3, 1976

[51] Int. Cl.[2] ..... F25B 49/00

[52] U.S. Cl. ..... 62/126; 62/180; 62/231

[58] Field of Search ..... 62/180, 186, 231, 126

[56] References Cited

U.S. PATENT DOCUMENTS

| | | | |
|---|---|---|---|
| 2,835,830 | 5/1958 | Rathenau | 126/39 BA |
| 3,444,391 | 5/1969 | Smith | 62/231 X |
| 3,474,639 | 10/1969 | Smith | 62/160 |

*Primary Examiner*—William E. Wayner
*Attorney, Agent, or Firm*—Edward P. Barthel

[57] ABSTRACT

A room air conditioner unit having an electric timer located at the control area with the timer including a timer motor which runs continuously and a timer switch electrically connected in the unit's control circuit with a manually operable multiple selector switch. Upon the timer switch being preset to open and close the control circuit allows the user to select either a timed electricity saver mode wherein the fan motor cycles on and off with the compressor or a timed cooling mode wherein the fan motor runs continuously while the compressor is cycled by the unit thermostat.

3 Claims, 5 Drawing Figures

E.S. = ELECTRI SAVER

| | SHAFT POSITION | CIRCUITS | | | | | | FUNCTION |
|---|---|---|---|---|---|---|---|---|
| | | F-L1 | L1-B | E-B | L1-C | E-C | L1-D | |
| 1ST | OFF | | | | | | | OFF |
| 2ND | CW 36 | X | | X | | | X | E. S. LO COOL |
| 3RD | CW 72 | X | | | | X | X | E.S. HI COOL |
| 4TH | CW 108 | | | X | | | X | E.S. TIMED LO COOL |
| 5TH | CW 144 | | | | | X | X | E.S. TIMED HI COOL |
| 6TH | CW 180 | X | X | | | | | LOW FAN ONLY |
| 7TH | CW 216 | | X | | | | X | TIMED LO COOL |
| 8TH | CW 252 | | | | X | | X | TIMED HI COOL |
| 9TH | CW 288 | X | X | | | | X | LO COOL |
| 10TH | CW 324 | X | | | X | | X | HI COOL |

ROOM AIR CONDITIONER WITH TIMER

This invention relates to a self-contained room air conditioner unit and is directed to a room air conditioner containing a timer located at the control panel area which is selectively operated in conjunction with the unit's control system.

The operation of room air conditioners by remote electric clock timers which merely turn the unit "ON" and "OFF" at present times is well known. One such arrangement is disclosed, for example, in U.S. Pat. No. 2,835,830 issued to Rathenau. The Rathenau patent provides a room air conditioning unit with a remote thermostat control including a timer mechanism for energizing the unit during preset periods as desired by manually adjustable means such as a pointer and a dial on a wall mounted face plate.

It is an object of the present invention to provide a timer located in the control area of a room air conditioner to provide a self-contained unit wherein the timer motor is energized continuously when the unit is plugged-in to a wall outlet, while the unit multiple selector switch is arranged in the control circuit with the timer motor and timer contacts allowing the user to select when the timer switch shall close and open to provide both timed and normal modes of operation.

It is a further object of the present invention to provide an improved control system for a room air conditioner incorporating a timer at the control area of the unit wherein the unit's multiple selector switch in one user selected position establishes an electricity saver circuit in which the fan motor is cycled on and off in unison with the compressor under control of a thermostat and wherein the same multiple selector switch allows the timer contacts to be selectively shunted into and out of the circuit to provide for a timed electricity-saving mode of operation or a conventional timed cooling cycle wherein the fan runs continuously while the compressor is cycled.

Further objects and advantages of the present invention will be apparent from the following description, reference being had to the accompanying drawings wherein a preferred embodiment of the present invention is clearly shown.

Figure 1:
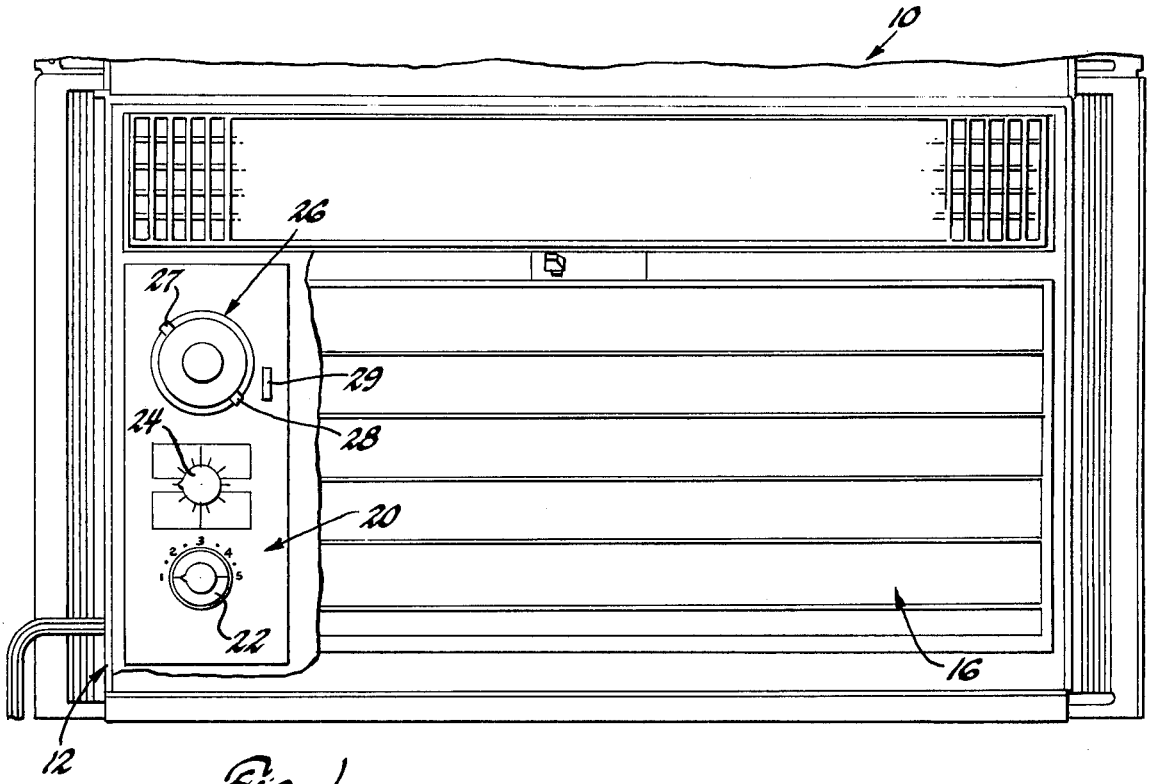
FIG. 1 is a view in front elevation of a room air conditioner front assembly with parts broken away, to show the control area.
Figure 3:
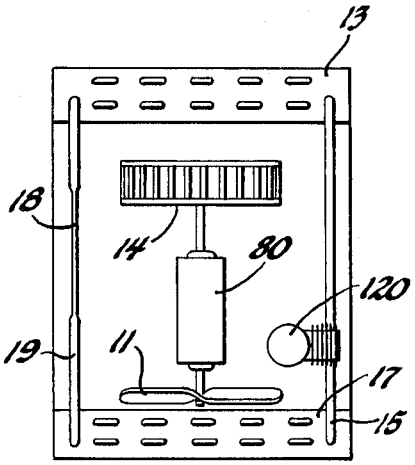
FIG. 3 is a diagrammatic view of an air conditioning unit.
Figure 2:
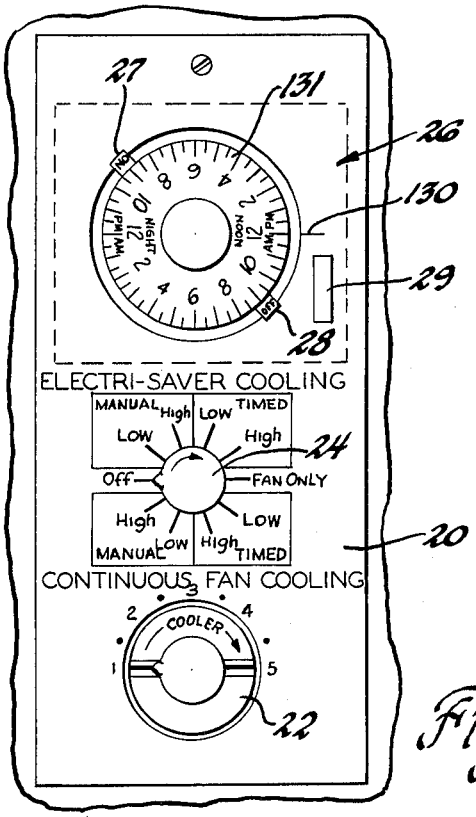
FIG. 2 is a fragmentary enlarged view of the room air conditioner control area.

Referring now to the drawings and more particularly to FIGS. 1-3, there is shown a room air conditioner 10 provided with an outer shell 12. Within the shell a base (not shown) supports a refrigeration system including a compressor, condensor, restrictor and evaporator of the refrigerant circuit, as well as room and outside air circulating fans. The construction of these parts may be similar to those of window and air conditioners now being commercially manufactured, examples of which are illustrated in U.S. Pat No. 3,792,593 to J. H. Loos et al., issued Feb. 19, 1974, and U.S. Pat. No. 3,592,123 to F. C. Henken, et al., issued July 13, 1971.

For the purposes of the present invention, it is only necessary to understand that the cabinet shell serves to enclose the operative components of the air conditioner unit including an evaporator 13 which is typically located in the front of the cabinet across most of the planar extent thereof; and air circulating fan 14 for drawing air across the evaporator for cooling it and then for returning the circulated air back into the room being cooled by the unit.

As seen in FIG. 3, the unit further includes an electric motor-driven refrigerant compressor 120 which connects by line 15 in series flow relationship with a condenser 17 and expansion device 18 in line 19 to the evaporator 13 which in turn is connected to the inlet of the compressor. Outdoor air fan 11 and circulating fan 14 are both operated by fan motor 80. The front assembly includes a horizontally slidable baffle 16, illustrated in its closed position, with a portion broken away to show control panel or escutcheon plate 20 having control components including a thermostat regulating knob 22.

Figures 4, 5:
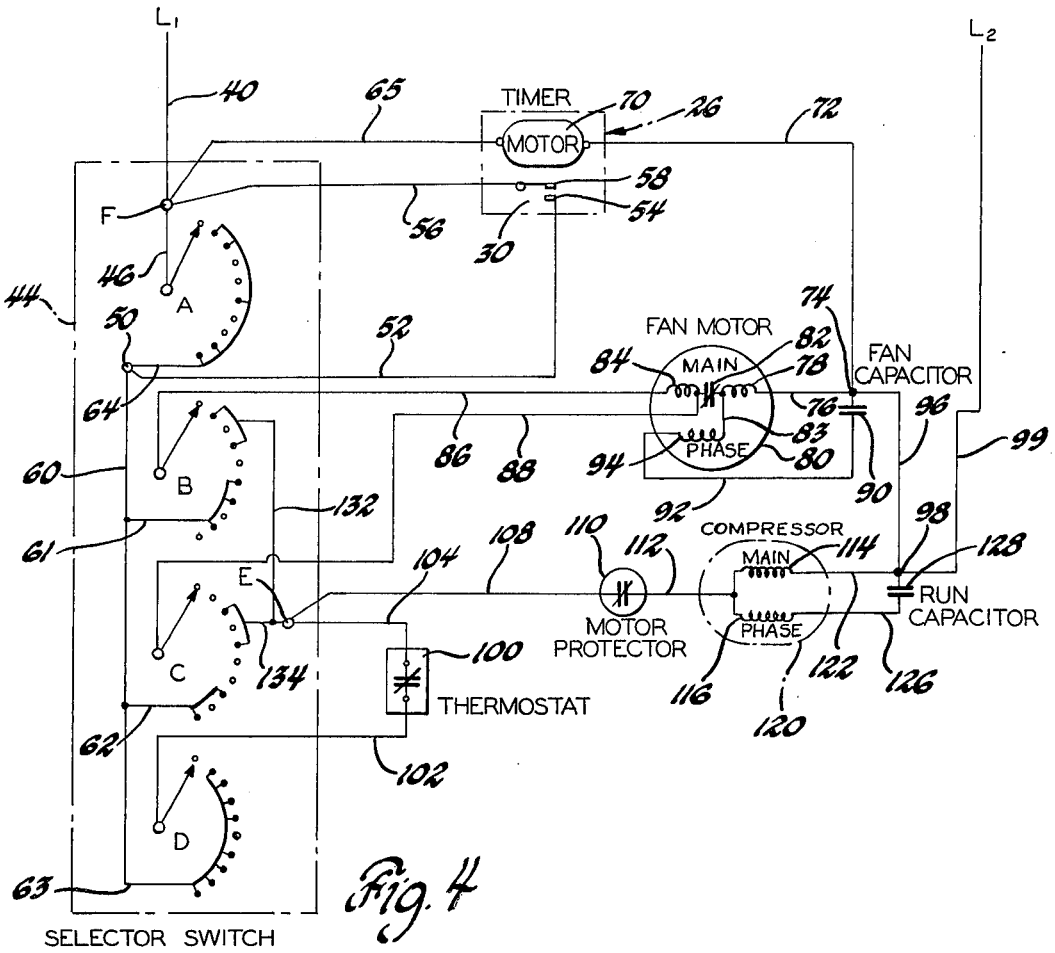
FIG. 4 is a schematic wiring diagram of the control system for the room air conditioner circuit.
FIG. 5 is a chart showing the positions of the selector switch to perform the desired functions.

The control panel 20 includes a rotatable selector switch knob 24 having a plurality of positions which in the disclosed embodiment provides ten selectable positions as shown by the FIG. 5 chart. Mounted on the control area with the selector switch knob 24 is a timer 26 including movable indicator 27 which is moved around the time dial clock for pointing to the exact A.M. or P.M. time the user wishes the air conditioner turned on while movable indicator 28 points to the hour the user wishes the air conditioner turned off. A push button on-off convenience switch 29 is provided for the timer to allow the user to reverse the mode of the timer 26. Positioning of indicator 27 establishes a time when coupling means will be effective to close timer switch 30 (FIG. 4); in similar fashion the position of indicator 28 determines when coupling means will be effective to open the timer switch 30. This timer clock mechanism is conventional and may be of the type manufactured by Intermatic Incorporated and is illustated solely for the purposes of explaining a suitable manner in which the present invention may be operated.

In FIG. 4 supply conductor L1 from a suitable 115V or 230V electrical power source is connected by line 40 to a first terminal F of a multiple selector switch means which in the disclosed form is the ten position manual rotary control snap or multiple selector switch 44. The switch A has its movable switch blade connected by line 46 to the terminal F.

A second terminal 50 of the multiple selector switch 44 is connected by line 52 to one contact 54 of the timer switch 30 while line 56 connects first selector switch terminal F to the other contact 58 of the timer switch. For the purposes of the disclosed embodiment contact 58 is shown as a movable contact while contact 54 is shown as a fixed contact of the timer switch 30.

Conductor 60, via lines 62 and 63, connects a second terminal 50 of the multiple selector switch 44 to the 10th fixed contact respectively of each selector switch C and D, while the line 61 connects the ninth fixed contact of the selector switch B to the terminal 50. The conductor 64 connects the 10th fixed terminal of the selector switch A to the second terminal 50.

The multiple selector switch 44 first terminal F is connected by the conductor 65 to one side of the timer motor 70 while conductor 72 connects the other side of the timer motor 70 to a terminal 74 from whence the conductor 76 connects with the high speed winding 78 of fan motor 80 and thence through internal motor protector 82 to a low speed winding 84 of the fan motor. Conductor 86 connects the movable switch blade of the selector switch B to the low speed winding 84 of the fan motor 80 while the conductor 88 connects the common junction of the low speed winding 84 and the motor protector 82 to the movable switch blade of the selector switch C. The terminal 74 is connected by fan capacitor 90 and line 92 to phase winding 94 while conductor 96 connects terminal 74 to terminal 98 with conductor 99 connecting terminal 98 to the other side of the power supply $L_2$.

One side of single stage thermostat 100 is connected by conductor 102 to the movable switch blade of the selector switch D, while the other side of the thermostat 100 is connected by a conductor 104 to selector switch contact E which is in turn connected by conductor 108 to a motor protector 110 and thence by conductor 112 to the main winding 114 and phase winding 116 of the compressor motor 120. The conductor 122 connects the opposite side of the compressor motor main winding to terminal 98 while conductor 126 connects the phase winding 116 to one side of run capacitor 128, while the capacitor other side is connected to terminal 98. The selector switch back contact E is connected by conductor 132 to the second and fourth fixed contacts of selector switch B, while the conductor 134 connects switch back contact E and conductor 132 to the third and fifth fixed contacts of selector switch C.

It will be seen in FIGS. 2 and 4 that with the air conditioner plugged-in supplying power to the $L_1$ and $L_2$ sides of the power source and with multiple selector switch knob 24 in its full counterclockwise off position the movable blades of selective contact switches A, B, C and D are each in contact with their respective open circuited first fixed contacts. The result is that a circuit is completed from the $L_1$ side of the line through conductor 40 to multiple selector switch terminal F, and thence via conductor 65 to one side of the timer motor 70, and from the other side of the timer motor via conductor 72 to terminal 74 and thence via conductors 96 and 99 to the $L_2$ side of the power source whereby the timer motor 70 runs continuously when the air conditioner is plugged into a conventional wall socket. Thus, the timer 26 operates to tell the user the time of day by means of an indicator marking 130 on the escutcheon plate or control panel 20 which indicator 130 is shown pointing to the 12 noon marking on the timer dial 131.

As viewed in FIG. 2, the multiple selector switch knob 24 may be rotated in a clockwise direction from its first or off position at 0° to its second position at 36° wherein the unit is placed in an electri-saver low cool mode of operation. In this mode, the selector switch A movable blade is connected to its second fixed contact resulting in the timer switch contacts 54 and 58 being shunted out of the control circuit with the current flow from terminal F following a path through conductor 46, the movable blade and the second fixed contact of selector switch A to terminal 50. A circuit is thus completed from terminal 50, line 60, the fixed contacts and movable blade of selector switch D, the line 102, thermostat 100, lines 104 switch back contact E, line 132 to the fixed contacts and movable blade of selector switch B, line 86, through both the fan motor windings 84 and 78 and lines 76, 96 and 99 to the $L_2$ side of the power source, wherein the fan motor runs at its low speed. In actuality the current is split in the fan motor and a small current flow exits from the motor protector 82 through internal lead 83, phase winding 94, line 92 and capacitor 90 to terminal 74.

To provide cooling in the selector switch second shaft position a refrigeration system circuit is established from the above low fan circuit to contact E and thence via conductor 108 to energize the compressor 120. It will be appreciated that by virtue of the fan motor circuit including the thermostat 100 the fan motor 80 is cycled on-and-off with the compressor to provide an "Electri-Saver Lo-Cool" mode.

Upon the selector switch knob 24 being moved clockwise to its third fixed contact, the selector switch A again shunts the timer motor switch contacts. The fan motor circuit path in this mode is the same to back contact E. It will be seen, however, that while the movable blade of selector switch B is in contact with its open fixed third contact the movable blade of selector switch C is in contact with its third closed fixed contact which establishes a current flow path from the back contact E line 134 to the movable blade of selector switch C and thence via conductor 88 and motor protector 82 to the high speed winding 78 of the fan motor 80 and thence via conductor 76, lines 96 and 99 to the $L_2$ side of the power source to energize the "Electri-Saver High Cool" mode wherein the fan is again cycled on-and-off with the compressor by the thermostat. It will be noted that the current feed to the fan motor 80 is divided and a small current flow passes from the motor protector 82 through internal lead 83 through the phase winding 94.

With the multiple selector switch knob 24 in its fourth clockwise position, the selector switch A movable blade is moved to its fourth fixed open contact whereby the shunt circuit of the selector switch A is inoperative and a timed circuit is completed from the terminal F, conductor 56 through the timer switch contacts 58 and 54, and thence via conductor 52 to switch terminal 50. In this fourth shaft position it will be seen that the movable blade of the selector switch B is connected to its fourth fixed contact which connects the selector switch through both the windings 84 and 78 of the fan motor thus operating the air conditioner in its Electri-Saver Timed Low Cool mode. This mode allows the user to select the time of the day when the air conditioner is automatically turned on and off via setting of the movable contacts 27 and 28 of the timer to cause automatic closing and opening of the timer contacts 54 and 58.

The selector switch knob 24 upon being rotated to its fifth clockwise shaft position places the air conditioner control circuit in an Electri-Saver Timed High Cool mode of operation wherein the circuit is the same as described for the Electri-Saver High Cool third mode of operation with the exception that the timer motor switch contacts 54 and 58 are again in the circuit and not shunted out by virtue of the selector switch A movable blade located at an open fixed contact. This allows the user to select a timed mode wherein the fan motor 80 runs at its fast speed and cycles on and off with the compressor 120.

Upon the selector switch being rotated to its sixth Low Fan Only position, it will be seen that the selector switches C and D movable blades are at open fixed contacts causing an open compressor and high speed fan motor circuits. Also, the selector switch A movable blade is at a closed fixed contact shunting the timer contacts. The selector switch B movable blade is in contact with its sixth fixed closed contact completing the low speed fan circuit whereby the air conditioner fan runs continuously.

When the selector switch knob 24 is moved to its seventh clockwise position there is provided a Timed Low Cool circuit wherein selector switch A movable blade is at an open fixed contact causing the timer contacts 54 and 58 to be placed in the control circuit to allow the user to select a timed low cool mode of operation.

In a similar manner upon the selector switch being moved to its eighth position the same control circuits described for the seventh position with the exception that a timed high fan mode of operation is provided by means of the selector switch C movable blade contacting its closed eighth fixed contact energizing the fan 80 to operate at a high speed by removing winding 84 from the circuit.

As seen in the chart of FIG. 4 upon the selector switch knob being rotated to its ninth shaft position a Low Cool control circuit is energized which is identical to position seven except that timer contacts 54 and 58 are shunted out of the control circuit by selector switch A movable blade contacting its closed ninth fixed contact.

With the selector switch knob 24 in its final 10th clockwise shaft position the air conditioner provides a High Cool control circuit that is identical to the eighth position except that again the timer contacts 54 and 58 are shunted out of the circuit to provide a manual continuous fan cooling mode of operation.

While the embodiment of the present invention as herein disclsoed constitutes a preferred form, it is to be understood that other forms might be adopted.

We claim:

1. In a self-contained room air conditioner unit including a housing enclosing a compressor driven by a motor,a condensor, an evaporator connected in a refrigerant circuit and a fan driven by a motor for circulating room air to be cooled into heat exchange relation with said evaporator; and in which said housing has a room-side section with a control area thereon; the invention comprising an electric timer located at said control area, said timer including a timer motor and timer switch electrically connected in a control circuit and a manually operable time preselector means to preset when said timer switch shall close and open by selecting start and stop times for selectively controlling the time of operation of said unit, said control circuit including first and second supply conductors adapted for connecting the compressor motor and the fan motor to a power source; thermostat switch means operative to cycle in response to the temperature of said circulating air; a multiposition manually operable cycle selector switch connected in said control circuit for selectively operating said unit in a timed cooling mode wherein said fan motor and said compressor motor are cycled on-and-off together by said thermostat switch means only during a timed period defined by starting and stopping times preselected by said timer preselector means; said cycle selector switch including timer shunt selective contact means, compressor motor selective contact means, and fan motor selective contact means; each said selective contact means having a movable contact side and a fixed contact side, said cycle selector switch having first terminal means in series connection between said first supply conductor and the movable contact side of said timer shunt selective contact means, said cycle selector switch having second terminal means common to the fixed contact side of each said selective contact means; said control circuit including as a compressor circuit portion thereof the compressor motor in series connection with said second terminal means, said fixed contact side of the compressor motor selector contact means, said movable contact side of the compressor motor selector contact means, said thermostat switch means and said second supply conductor; said control circuit including as a fan motor circuit portion thereof the fan motor in series connection with said second terminal means, said fixed contact side of said compressor motor selector contact means, said movable contact side of said compressor motor selector contact means, said thermostat switch means, said fixed contact side of said fan motor selective contact means, said movable contact side of said fan motor selective contact means, and said second supply conductor; said timer motor having one side connected to said first terminal means and its other side connected to said second supply conductor whereby said timer motor runs continuously when said supply conductors are connected to said power source, said timer switch being connected between said first terminal means and said second terminal means, whereby upon manual operation of the movable contacts of said cycle selector switch to a predetermined position, said timer shunt selective contact means is electrically shunted in said control circuit by said timer switch which is electrically placed in series with said first and second terminal means to enable said unit to operate in said timed cooling mode for a time in accordance with the start and stop times preselected by said manually operable time preselector.

2. In a self-contained room air conditioner unit including a housing enclosing a compressor driven by a motor, a condenser, an evaporator connected in a refrigerant circuit and a fan driven by a motor for circulating room air to be cooled into heat exchange relation with said evaporator; and in which said housing has a room-side section with a control area thereon; the invention comprising an electric timer located at said control area, said timer including a timer motor and timer switch electrically connected in a control circuit and a manually operable time preselector means to preset when said timer switch shall close and open by selecting start and stop times for selectively controlling the time of operation of said unit, said control circuit including first and second supply conductors adapted for connecting the compressor motor and the fan motor to a power source; thermostat switch means operative to cycle in response to the temperature of said circulating air; a multi-position manually operable cycle selector switch connected in said control circuit for selectively operating said unit in either a continuous cooling mode wherein said fan motor and said compressor motor are cycled on-and-off together by said thermostat switch means; or a timed cooling mode wherein said fan motor and said compressor motor are cycled on-and-off together by said thermostat switch means only during a timed period defined by starting and stopping times preselected by said time preselector means; said cycle selector switch including timer shunt selective contact means, compressor motor selective contact means, and fan motor selective contact means; each said selective contact means having a movable contact side and a fixed contact side, said cycle selector switch having first terminal means in series connection between said first supply conductor and the movable contact side of said timer shunt selective contact means, said cycle selector switch having second terminal means common to the fixed contact side of each said selective contact means; said control circuit including as a compressor circuit portion thereof the compressor motor in series connection with said second terminal means, said fixed contact side of the compressor motor selector contact means, said movable contact side of the compressor motor selector contact means, said thermostat switch means and said second supply conductor; said control circuit including as a fan motor circuit portion thereof the fan motor in series connection with said second terminal means, said fixed contact side of said compressor motor selector contact means, said movable contact side of said compressor motor selector contact means, said thermostat switch means, said fixed contact side of said fan motor selective contact means, said movable contact side of said fan motor selective contact means, and said second supply conductor; said timer motor having one side connected to said first terminal means and its other side connected to said second supply conductor whereby said timer motor runs continuously when said supply conductors are connected to said power source, said timer switch being connected between said first terminal means and said second terminal means, whereby upon manual operation of the movable contacts of said cycle selector switch to a first predetermined position, said timer switch electrically shunted in said control circuit by said timer shunt selective contact means to enable said unit to operate in said continuous cooling mode, and whereby upon manual operation of the movable contacts of said cycle selector switch to a second predetermined position, said timer shunt selective contact means is electrically shunted in said control circuit by said timer switch which is electrically placed in series with said first and second terminal means to enable said unit to operate in said timed cooling mode for a time in accordance with the start and stop times preselected by said manually operable time preselector.

3. The invention of claim 1 wherein the electric timer includes a timer-of-day face exposed at said control area and operated continuously with said timer motor for telling the time-of-day.

* * * * *